US008289265B2

(12) United States Patent
Shen et al.

(10) Patent No.: US 8,289,265 B2
(45) Date of Patent: Oct. 16, 2012

(54) BACKLIGHT CONTROLLER, DISPLAY DEVICE USING THE SAME AND METHOD FOR CONTROLLING BACKLIGHT MODULE

(75) Inventors: Kuo-Liang Shen, Tainan County (TW); Chien-Chung Chen, Tainan County (TW); Shing-Chia Chen, Tainan County (TW)

(73) Assignees: Himax Technologies Limited, Tainan (TW); Himax Media Solutions, Inc., Tainan (TW)

( * ) Notice: Subject to any disclaimer, the term of this patent is extended or adjusted under 35 U.S.C. 154(b) by 1127 days.

(21) Appl. No.: 12/173,234

(22) Filed: Jul. 15, 2008

(65) Prior Publication Data

US 2010/0013871 A1 Jan. 21, 2010

(51) Int. Cl.
*G09G 3/36* (2006.01)

(52) U.S. Cl. ..... 345/102; 349/61; 362/97.1

(58) Field of Classification Search ..... 345/102; 349/61–71; 362/97.1–97.4
See application file for complete search history.

(56) References Cited

U.S. PATENT DOCUMENTS

2007/0188438 A1* 8/2007 Fletcher et al. ..... 345/102
2008/0068328 A1* 3/2008 Jou et al. ..... 345/102
2009/0086473 A1* 4/2009 Tan et al. ..... 362/229

* cited by examiner

*Primary Examiner* — Amr Awad
*Assistant Examiner* — Michael Pervan
(74) *Attorney, Agent, or Firm* — J.C. Patents

(57) ABSTRACT

A backlight controller, a display device using the same and a method for controlling a backlight module are provided. The backlight controller includes a temporal weighting module and a dimming controlling module. The temporal weighting module calculates a weight sum of a first backlight luminance provided in a current frame and a target backlight luminance to serve as an adjusted backlight luminance. The target backlight luminance is obtained according to an image content of the current frame. The dimming controlling module increases or decreases the adjusted backlight luminance by a step value according to the target backlight luminance and generates a second backlight luminance provided in a next frame. Therefore, a backlight luminance of the backlight module not only can be smoothly adjusted to the target backlight luminance at high speed for avoiding backlight flicker, but also can be adaptive to image content for saving electric power consumption.

6 Claims, 3 Drawing Sheets

BACKLIGHT CONTROLLER, DISPLAY DEVICE USING THE SAME AND METHOD FOR CONTROLLING BACKLIGHT MODULE

BACKGROUND OF THE INVENTION

1. Field of the Invention

The present invention relates to a backlight controller and a method for controlling a backlight module, and more particularly, to a device and a method that adjust a backlight luminance of the backlight module to a target backlight luminance.

2. Description of Related Art

In recent years, flat panel displays, such as liquid crystal displays (LCDs), have enjoyed burgeoning development and flourished. Due to the numerous advantages of the LCD, such as low power consumption, free of radiation, and high space utilization, the LCD has become the main stream in the market. An LCD includes a liquid crystal display panel and a backlight module. The liquid display panel has no capacity of emitting light by itself so that the backlight module is arranged below the liquid display panel to provide the backlight for the liquid crystal display panel.

However, analyzing the electric power consumption of the LCD, the backlight module takes up 80% to 90% of the entire. For the large-size LCD panel, the LCD consumes considerable electricity. Generally, the image frame displayed on LCD panel may be light or dark, but actually, the electric power consumption of the backlight module is the same. That is to say the backlight module operates with 100% duty cycle whatever the image frames change. For this reason, many designers are devoted in saving electric power consumption of the backlight module.

One way to solve the said problem is to control the backlight luminance by referring the image. For example, the backlight luminance is decreased as the image is darker, and the backlight luminance is increased as the image is brighter. Nevertheless, if the image is extremely changed from one frame to another, the way of adjusting the backlight luminance causes unexpected backlight flicker due to the characteristics of different image frames.

SUMMARY OF THE INVENTION

The present invention provides a backlight controller and a method for controlling a backlight module that smoothly adjust a backlight luminance of the backlight module to a target backlight luminance at high speed for avoiding backlight flicker. Besides, the present invention also provides a display device using the said backlight controller for obtaining better display quality.

A backlight controller is provided in the present invention. The backlight controller includes a temporal weighting module and a dimming controlling module. The temporal weighting module computes a weight sum of a first backlight luminance provided in a current frame and a target backlight luminance to serve as an adjusted backlight luminance. The target backlight luminance is obtained according to the image content of the current frame. The dimming controlling module is coupled to the temporal weighting module, and the dimming controlling module increases or decreases the adjusted backlight luminance by a step value according the target backlight luminance and thereby generates a second backlight luminance provided in the next frame.

In an embodiment of the foregoing backlight controller, the dimming controlling module increases the adjusted backlight luminance by the step value to serve as the second luminance when the adjusted backlight luminance is less than target backlight luminance. On the contrary, the dimming controlling module decreases the adjusted backlight luminance by the step value to serve as the second luminance when the adjusted backlight luminance is greater than the target backlight luminance.

A method for controlling a backlight module is provided in the present invention. First, a weight sum of a backlight luminance provided in the current frame and a target backlight luminance is calculated as an adjusted backlight luminance. The target backlight luminance is obtained according to an image content of the current frame. The adjusted backlight luminance is increased or decreased by a step value according to the target backlight luminance and thereby a second backlight luminance is provided in a next frame.

In an embodiment of the foregoing method for controlling the backlight module, the adjusted backlight luminance is increased by the step value to serve as the second backlight luminance when the adjusted backlight luminance is less than the target backlight luminance. On the contrary, the adjusted backlight luminance is decreased by the step value to serve as the second backlight luminance when the adjusted backlight luminance is greater than the target backlight luminance.

A display device is provided in the present invention. The display device includes a display panel, a backlight controller, and a backlight module. The display panel displays an image. The backlight module provides a backlight to the display panel. The backlight controller refers a first backlight luminance provided in a current frame and a target luminance to generate a second backlight luminance provided in a next frame, and thereby controls the backlight module to provide the backlight. The target backlight luminance is obtained according to the content of the image.

In an embodiment of the foregoing display device, the backlight controller includes a temporal weighting module and a dimming controlling module. The temporal weighting module calculates a weight sum of the first backlight luminance and a target backlight luminance to serve as an adjusted backlight luminance. The target backlight luminance is obtained according to the content of an image. The dimming controlling module is coupled to the temporal weighting module. The dimming controlling module increases or decreases the adjusted backlight luminance by a step value according to the target backlight luminance, and thereby generates the second backlight luminance.

The present invention provides the backlight controller and the method for controlling a backlight module that performs the weighting process on the first backlight luminance provided in the current frame and the target backlight luminance to obtain the adjusted backlight luminance. Further, the adjusted backlight luminance is increased or decreased by the step value according to the target backlight luminance for smoothly adjusting the backlight luminance of the backlight module to the target backlight luminance. Therefore, the backlight flicker can be diminished for better display quality.

In order to make the features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
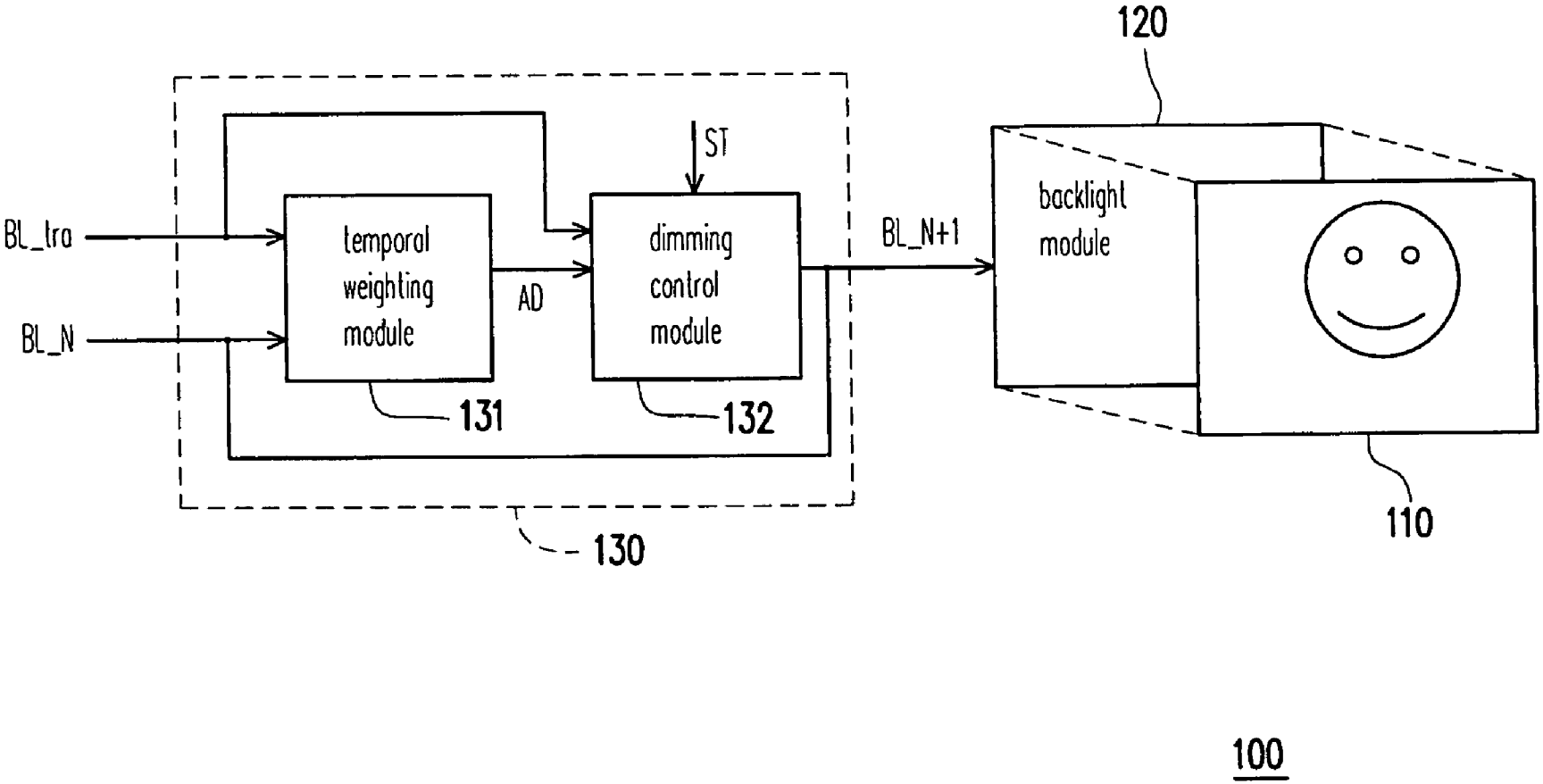
FIG. 1A is a block diagram of a display device according to an embodiment of the present invention.

Reference will now be made in detail to the present embodiments of the invention, examples of which are illustrated in the accompanying drawings. Wherever possible, the same reference numbers are used in the drawings and the description to refer to the same or like parts.

FIG. 1A is a block diagram of a display device according to an embodiment of the present invention. Referring to FIG. 1A, it is assumed that the display device 100 is a liquid crystal display (LCD) or a liquid crystal on silicon display (LCOS). The display device 100 includes a display panel 110, a backlight module 120, and a backlight controller 130. Since the display panel 110 has no capacity of emitting light by itself, the backlight module 120 provides a backlight for the display panel 110 to display an image frame by frame. In the embodiment, the backlight controller 130 can analyze an image content of a current frame in statistic, e.g. the luminance distribution histogram of the image content, to obtain a target backlight luminance BL_tar. The current frame, for example, is the $N^{th}$ frame, and the backlight luminance provided in the current frame is denoted as BL_N. The target backlight luminance BL_tar is utilized for adjusting the backlight luminance BL_N+1 provided in a next frame, i.e. the $(N+1)^{th}$ frame.

If the image frames extremely change from one to another, the target backlight luminance BL_tar corresponding to different image frames would be quite different. Only providing the target backlight luminance BL_tar in the next frame right away may cause unexpected backlight flickers. The backlight controllers 130 refers a backlight luminance BL_N provided in the current frame and the target backlight luminance BL_tar to generate the backlight luminance BL_N+1 provided in the next frame, and the backlight controller 130 thereby controls the backlight module 120 to provide the backlight with the backlight luminance BL_N+1. Hence, the backlight luminance of the backlight module 120 can be adaptive to the image content for saving the electric power consumption of the backlight module 120 and can be smoothly adjusted to the target backlight luminance BL_tar for avoiding backlight flicker. The following describes the backlight controllers 130 in detail.

Referring to FIG. 1A, the backlight controller 130 includes a temporal weighting module 131 and a dimming control module 132. The temporal weighting module 131 calculates a weight sum of the backlight luminance BL_N provided in the current frame and the target backlight luminance BL_tar to serve as an adjusted backlight luminance AD. The dimming controlling module 132 is coupled to the temporal weighting module 131. The dimming controller module 132 increases or decreases the adjusted backlight luminance AD by a step value ST frame by frame according to the target backlight luminance BL_tar and thereby generates the backlight luminance BL_N+1 provided in the next frame.

It is assumed that the weight sum of the backlight luminance BL_N provided in the current frame and the target backlight luminance BL_tar is equal to BL_tar×W+BL_N×(1−W), wherein W is a reference weight related to a gray scale average of the image content. The gray scale average of the image content, for example, is 128, since eight bits are often utilized for representing the gray scale of a pixel from 0 to 255. The reference weight W is normalized as 128/255, which is about 0.5. The target backlight luminance BL_tar changes as the image content so that the backlight luminance BL_tar should be refreshed in every frame. The temporal weighting module 131 is started to perform weighting process when the variation of the target backlight luminance BL_tar exceeds a predetermined range.

Figure 1B:
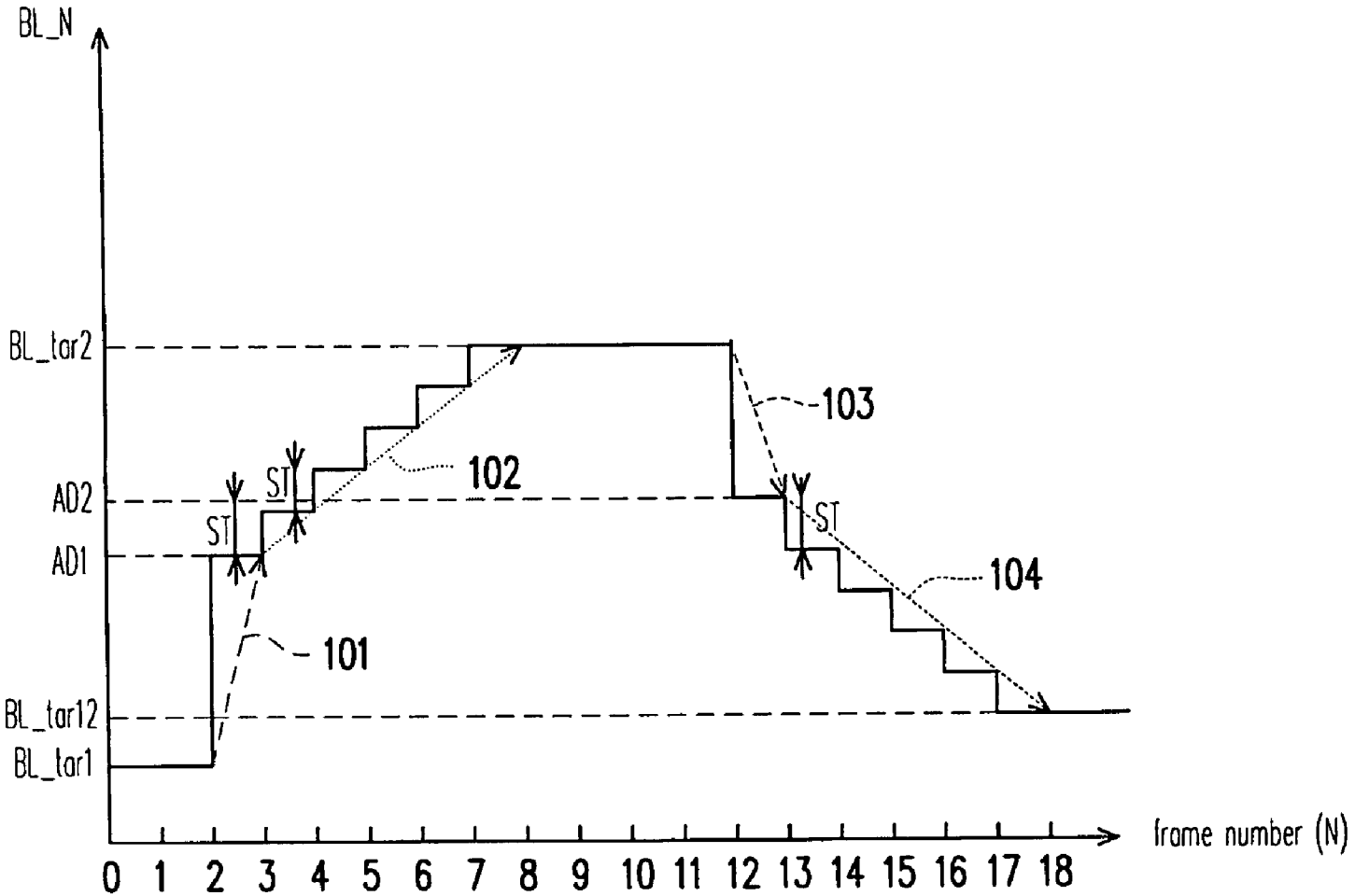
FIG. 1B is a curve diagram of the backlight luminance of the backlight module 120 changing as the image frames according to the embodiment in FIG. 1A.

FIG. 1B is a curve diagram of the backlight luminance of the backlight module 120 changing as the image frames according to the embodiment in FIG. 1A. Referring to FIGS. 1A and 1B, when the $2^{nd}$ frame is displayed, the target backlight luminance BL_tar2 of the $2^{nd}$ frame can be computed according to the image content of the $2^{nd}$ frame, and the backlight luminance BL_2 provided in the $2^{nd}$ frame is known. Since the variation between the target backlight luminance BL_tar1 of the $1^{st}$ frame and the target backlight luminance BL_tar2 of the $2^{nd}$ frame exceeds the predetermined range, the temporal weighting module 131 is started to calculate a weight sum of the backlight luminance BL_2 provided in the $2^{nd}$ frame and the target backlight luminance BL_tar2 of the $2^{nd}$ frame to serve as the adjusted backlight luminance AD1. Then, as the dotted line 101 with an arrow shown, when the $3^{rd}$ frame is displayed, the dimming controlling module 132 controls the backlight module 120 to provide the backlight with the adjusted backlight luminance AD1. In other word, the dimming controlling module 132 provides the adjusted backlight luminance AD1 to serve as the backlight luminance BL_3 provided in the $3^{rd}$ frame when the variation of the target backlight luminance exceeds the predetermined range.

For convenience of description, if the variation of the target backlight luminance between the current frame and the previous frame, e.g. the $3^{rd}$ and $2^{nd}$ frames, does not exceed than the predetermined range, the symbol of the target backlight luminance of the previous frame is quoted to represent the target backlight luminance of the current frame in the embodiment, but actually, the target backlight luminance of the current frame is refreshed. In the embodiment, the variation of the target backlight luminance from the $2^{nd}$ through $11^{th}$ frames is within the predetermined range, and the target backlight luminance of each of these frames is denoted as BL_tar2.

Next, as the dotted line 102 with an arrow shown, the dimming controlling module 132 increases the backlight luminance BL_3 provided in the $3^{rd}$ frame (i.e. the adjusted backlight luminance AD1) by the step value ST to serve as the backlight luminance BL_4 provided in the $4^{th}$ frame since the backlight luminance BL_3 provided in the $3^{rd}$ frame is less than the target backlight luminance BL_tar2. In the case, the temporal weighting module 131 can set the reference weight W to be zero, and the dimming controlling module 132 sequentially increases the backlight luminance provided in the current frame by the step value ST to serve as the backlight luminance provided in the next frame until the backlight luminance BL_8 provided in the $8^{th}$ frame is close to or equal to the target backlight luminance BL_tar2. Then, the dimming controlling module 132 provides the target backlight luminance BL_tar2 in the $9^{th}$ through $12^{th}$ frames.

As the foregoing description, when the $12^{th}$ frame is displayed, the target backlight luminance BL_tar12 of the $12^{th}$ frame can be obtained according to the image content of the $12^{th}$ frame. Since the variation between the target backlight luminance BL_tar12 and the target backlight luminance BL_tar2 exceeds the predetermined range, the temporal weighting module 131 is started to perform the weighting process on the target backlight luminance BL_tar12 and the backlight luminance BL 12 provided in the $12^{th}$ frame so that the adjusted backlight luminance AD2 can be obtained. As the dotted line 103 with an arrow shown, the dimming controlling module 132 provides the adjusted backlight luminance AD2 to serve as the backlight luminance BL_13 provided in the $13^{th}$ frame. As the dotted line 104 with an arrow shown, the dimming controlling module 132 decreases the backlight luminance provided in the current frame by the step value ST to serve as the backlight luminance provided in the next frame since the backlight luminance provided in the current frame is greater than the target backlight luminance BL_tar12.

It is noted that the step value ST is adjustable. For example, the backlight controller 130 can analyzes an error derived from the backlight luminance BL_N provided in the current frame and the target backlight luminance BL_tar in statistics, and thereby adjusts the step value ST. Referring to FIG. 1A, by the operation of the temporal weighting module 131, the backlight controller 130 does not dramatically change the backlight luminance BL_N provided in the current frame to the target backlight luminance BL_tar, but to the adjusted backlight luminance AD for avoiding the backlight flicker. The weighting process performed by the temporal weighting module 131 can adjust the backlight luminance BL_N provided in the current frame to the target backlight luminance BL_tar at high speed. Cooperating with the dimming controlling module 132, the backlight controller 130 smoothly adjusts the backlight luminance BL_N provided in the current frame to the target backlight luminance BL_tar.

Figure 2:
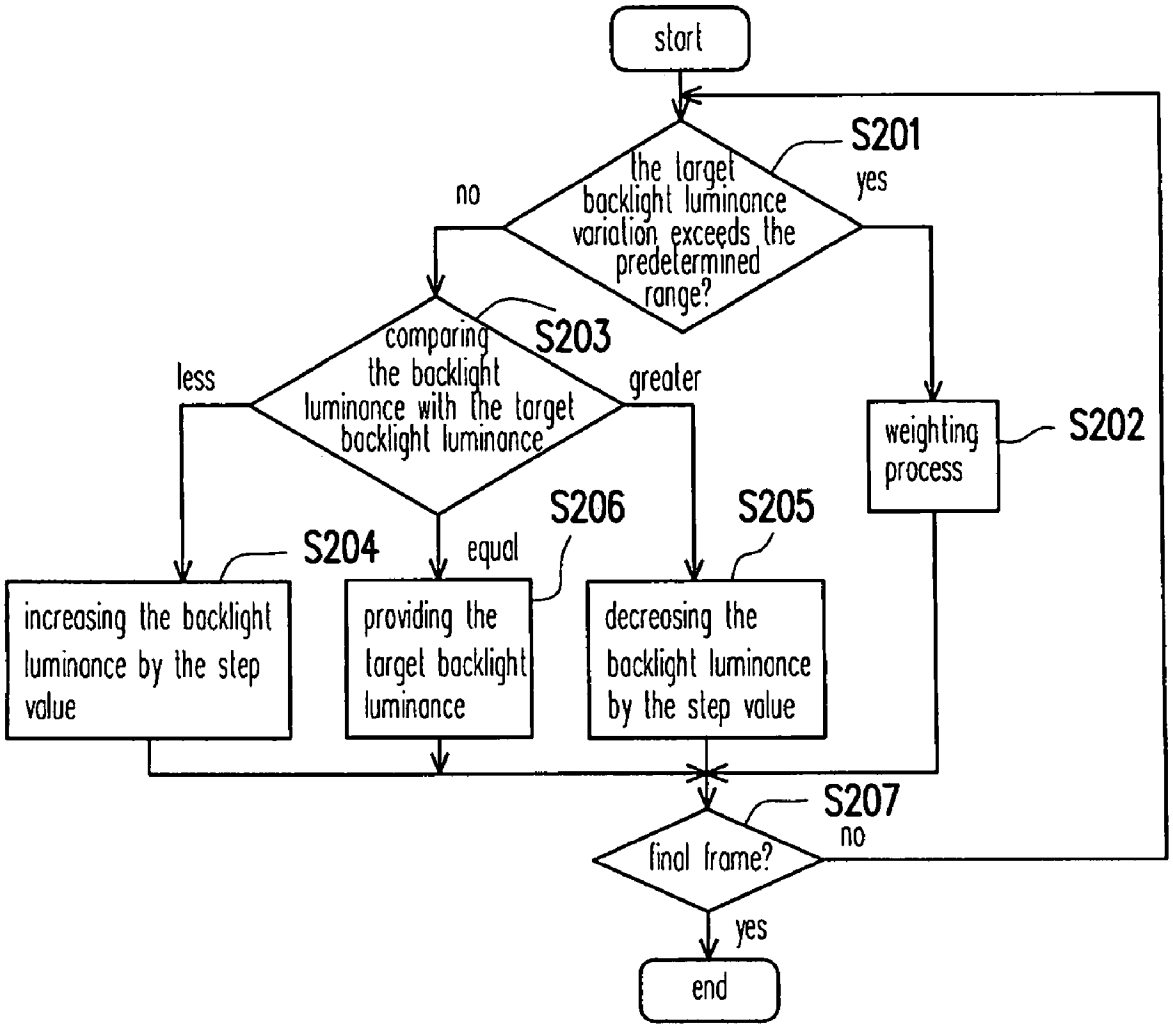
FIG. 2 is a flowchart of a method for controlling a backlight module according to an embodiment of the invention.

According to the embodiment described above, the steps of the following method could be generalized. FIG. 2 shows a flowchart of a method for controlling a backlight module according to an embodiment of the invention. Referring to FIG. 1A and FIG. 2, when the target backlight luminance BL_tar of the current frame is obtained according to the image content of the current frame, whether the variation of the target backlight luminance BL_tar exceeds the predetermined range is determined in the step S201. In the step S202, if the variation of the target backlight luminance exceeds the predetermined range, a weighting process is performed to calculate a weight sum of the backlight luminance BL_N provided in the current frame and the target backlight luminance BL_tar to serve as the adjusted backlight luminance AD, wherein the adjusted backlight luminance serves as the backlight luminance BL_N+1 provided in the next frame. For example, the adjusted backlight luminance is equal to BL_tar×W+BL_N×(1−W), wherein W is a reference weight related to a gray scale average of the image content.

If the variation of the target backlight luminance BL_tar does not exceed the predetermined range, the backlight luminance BL_N provided in the current frame is compared with the target backlight luminance BL_tar in step S203. In step S204, if the backlight luminance BL_N provided in the current frame is less than the target backlight luminance BL_tar, the backlight luminance BL_N is increased by the step value ST to serve as the backlight luminance BL_N+1 provided in the next frame. In the step S205, if the backlight luminance BL_N provided in the current frame is greater than the target backlight luminance BL_tar, the backlight luminance BL_N is decreased by the step value ST to serve as the backlight luminance BL_N+1 provided in the next frame. In the step S206, if the backlight luminance BL_N provided in the current frame is equal to the target backlight luminance BL_tar, the target backlight luminance BL tar serves as the backlight luminance BL_N+1 provided in the next frame.

After the processes in either one of the steps S204, S205 or S206, whether the current frame is the final frame is determined in the step S207. If the current frame is not the final frame, the method for controlling the backlight module will keep processing the next frame for adjusting the backlight luminance of the backlight module. The method for controlling the backlight module smoothly adjusts the backlight luminance to the target backlight luminance without spending a lot of time and can diminish the unexpected backlight flicker for better display quality.

In summary, the said embodiments perform the weighting process on the backlight luminance provided in the current frame and the target backlight luminance for obtaining the adjusted backlight luminance. Then, the adjusted backlight luminance is increased or decreased by the step value according to the target backlight luminance. The backlight luminance provided in the next frame is adjusted according to the backlight luminance provided in the current frame. Instead of dramatically adjusting the backlight luminance to the target backlight luminance, the backlight luminance is smoothly adjusted to the target backlight luminance for avoiding the backlight flickers and obtaining better display quality. The time spent for adjusting is not long since the adjusted backlight luminance obtained by the weighting process is close to the target backlight luminance. Besides, the backlight controller applied in the display device can save power consumption by adaptively adjusting the backlight luminance according to the image content.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. A backlight controller, comprising:

a temporal weighting module, calculating a weight sum of a first backlight luminance provided in a current frame and a target backlight luminance to serve as an adjusted backlight luminance, which equal to L1×W+L2×(1−W), only when the variation of the target backlight luminance in comparison with the backlight luminance of the immediate previous image frame exceeds a predetermined range, wherein L1 is the target backlight luminance, L2 is the first backlight luminance, W is a reference weight which equals to a gray scale average of the image content of the current frame divided by the maximum gray scale level of an image frame, and the target backlight luminance is obtained from analyzing the statistics of an image content of the current frame; and a dimming controlling module, coupled to the temporal weighting module for increasing or decreasing the adjusted backlight luminance by a step value of the target backlight luminance, and thereby generating a second backlight luminance provided in a next frame.

2. the backlight controller as claimed in claim 1, wherein the dimming controlling module increases the adjusted backlight luminance by the step value to serve as the second backlight luminance when the adjusted backlight luminance is less than the target backlight luminance, and the dimming controlling module decreases the adjusted backlight luminance by the step value to serve as the second backlight luminance when the adjusted backlight luminance is greater than the target backlight luminance.

3. A display device, comprising:

a display panel, for displaying an image;

a backlight module, providing a backlight to the display panel; and a backlight controller, referring a first backlight luminance provided in a current frame and a target luminance to generate a second backlight luminance provided in a next frame only when the variation of the target backlight luminance in comparison with the backlight luminance of the immediate previous image frame exceeds a predetermined range, and thereby controlling the backlight module to provide the backlight, wherein the target backlight luminance is obtained from analyzing the statistics of an image content of the current frame, and the backlight controller comprises a temporal weighting module, calculating a weight sum of the first backlight luminance and the target backlight luminance to serve as an adjusted backlight luminance, which equals to $L1\times W+L2\times(1-W)$, wherein L1 is the target backlight luminance, L2 is the first backlight luminance, and W is a reference weight which equals to a gray scale average of the image content of the current frame divided by the maximum gray scale level of an image frame; and a dimming controlling module, coupled to the temporal weighting module for increasing or decreasing the adjusted backlight luminance by a step value according to the target backlight luminance, and thereby generating the second backlight luminance.

4. The display device as claimed in claim 3, wherein the dimming controlling module increases the adjusted backlight luminance by the step value to serve as the second backlight luminance when the adjusted backlight luminance is less than the target backlight luminance, and the dimming controlling module decreases the adjusted backlight luminance by the step value to serve as the second backlight luminance when the adjusted backlight luminance is greater than the target backlight luminance.

5. The display device as claimed in claim 3, wherein the dimming controlling module provides the adjusted backlight luminance as the second backlight luminance when variation of the target backlight luminance exceeds a predetermined range or when the adjusted backlight luminance equals the target backlight luminance.

6. A method for controlling a backlight module, comprising:

determining if the variation of the target backlight luminance in comparison with the backlight luminance of the immediate previous image frame exceeds a predetermined range; and if so, calculating a weight sum of a first backlight luminance provided in a current frame and a target backlight luminance as an adjusted backlight luminance, which is equal to $L1\times W+L2\times(1-W)$, to be served as a second backlight luminance in a next frame, wherein L1 is the target backlight luminance, L2 is the first backlight luminance, W is a reference weight which equals to a gray scale average of the image content of the current frame divided by the maximum gray scale level of an image frame, and the target backlight luminance is obtained from analyzing the statistics of an image content of the current frame;

and if not, then the adjusted backlight luminance is increased by the step value to serve as the second backlight luminance when the adjusted backlight luminance is less than the target backlight luminance, and the adjusted backlight luminance is decreased by the step value to serve as the second backlight luminance when the adjusted backlight luminance is greater than the target backlight luminance.

* * * * *